US009675111B2

(12) United States Patent
Ellis

(10) Patent No.: US 9,675,111 B2
(45) Date of Patent: Jun. 13, 2017

(54) VAPORIZER FOR USE WITH A SMOKING WATER PIPE

(71) Applicant: Matthew Ellis, Englewood, CO (US)

(72) Inventor: Matthew Ellis, Englewood, CO (US)

( * ) Notice: Subject to any disclaimer, the term of this patent is extended or adjusted under 35 U.S.C. 154(b) by 993 days.

(21) Appl. No.: 13/940,015

(22) Filed: Jul. 11, 2013

(65) Prior Publication Data

US 2015/0013699 A1 Jan. 15, 2015

(51) Int. Cl.
*A24F 13/00* (2006.01)
*A24F 47/00* (2006.01)
*A24F 1/30* (2006.01)

(52) U.S. Cl.
CPC ..... *A24F 47/008* (2013.01); *A24F 1/30* (2013.01)

(58) Field of Classification Search
None
See application file for complete search history.

(56) References Cited

U.S. PATENT DOCUMENTS 4,682,610 A * 7/1987 Freelain ..... A24F 1/30 131/173
2010/0126516 A1* 5/2010 Yomtov ..... A24F 1/30 131/173

* cited by examiner

*Primary Examiner* — Phu Nguyen
(74) *Attorney, Agent, or Firm* — Keaty Law Firm, LLC

(57) ABSTRACT

A vaporizer for use with a water pipe or hookah has electrically heated beating element. The heating element extends through a vaporizer body and carries a cup member atop thereof. A pre-determined quantity of a vaporizable substance is placed in the cup member and is heated to cause release of an inhalable gas. An adapter directs the inhalable gas beneath water surface of a water reservoir of the water pipe. By drawing on an outlet end of the water pipe the user can inhale the inhalable substance released during heating of the vaporizable substance.

24 Claims, 3 Drawing Sheets

VAPORIZER FOR USE WITH A SMOKING WATER PIPE

BACKGROUND OF THE INVENTION

The invention relates to smoking apparatuses, and more particularly to a vaporizer used with a water pipe. Even more particularly, the present invention relates to an apparatus for heating vaporizable substance using electricity as a heat source.

Water pipes or hookahs have been, known for centuries. These smoking devices were used throughout the Middle East and became known in the West under different names, such as narghile, arghila, or qalyan. The term "water pipe" and "hookah" will be used interchangeably to encompass all such smoking devices. A conventional water pine is a single- or multi-stemmed glass vessel in which the vapor or smoke is passed through a water basin before inhalation. Such, smoking instrument is used for vaporizing and smoking flavored tobacco and different botanical substances. One or more flexible hoses extend outward than, the body of the water pipe. By drawing the smoke through a water reservoir, the smoke is filtered and cooled. A user inhales the smoke that passed through the water through a flexible hose connected to the water pipe. However, open-flame hookahs present serious safety issues.

In recent years, interest has grown in the technique of vaporization in which the smoking material is carefully heated so that the desired flavor of the botanical substance is liberated, while tire hazard is minimized. Additionally, vaporization provides many benefits over smoking, including reduction in the amount of toxic carcinogenic flammable substances generated during heating of the botanical material. Also, vaporization is smoother and more flavorful and lacks a burned taste that many find disagreeable.

However, vaporization is difficult to perform using conventional hookah designs. For many botanical substances admixed with a required carrier vaporization only occurs in a relatively narrow temperature range. Some substances require healing up to 800 degrees Fahrenheit to achieve the release of vaporizable compound. It would be an advance in the art of vaporization devices to provide a vaporizer that can fee connected to a conventional water pipe for delivery of released gas through the water basin in the water pipe. Such a device could be widely used by tobacco smokers as well as by users of medicinal herbs and substances.

SUMMARY OF THE INVENTION

It is, therefore, an object of the present invention, to provide a vaporizer for use with a smoking water pipe or hookah.

It is another object m the invention to provide a vaporizer that can heat the vaporizable substance to a sufficiently high temperature to cause vaporization of gaseous substance.

It is a further object, of the invention to provide an electrically-powered vaporizer capable of hearing a vaporizable botanical substance to 800 degrees Fahrenheit or higher.

These and other objects of the invention are achieved through a provision of A vaporizer for use with a water pipe or hookah has electrically heated heating element. The heating element extends through a vaporizer body and carries a cup member atop thereof. A pre-determined quantity of a vaporizable substance is placed in the cup member and is heated to cause release of an inhalable gas. An adapter directs the inhalable gas beneath water surface of a water reservoir of the water pipe. By drawing on an outlet end of the water pipe the user can inhale the inhalable substance released during heating of the vaporizable substance.

The adapter has a stem engageable co-axially with the vaporizer body and a side bend member extending at an angle to the stem. The side bend member is detachable engageable with the receiver of the water pipe.

BRIEF DESCRIPTION OF THE DRAWINGS

Reference will now be made to the drawings, wherein like parts are designated by like numerate, and wherein.

DETAIL DESCRIPTION OF THE INVENTION

Figure 1:
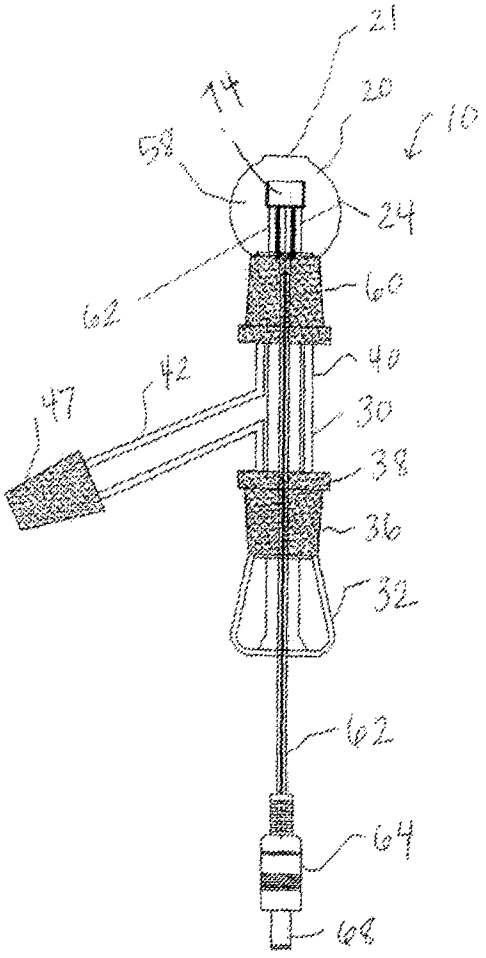
FIG. 1 is a front view of the vaporizer apparatus according to the present invention.

Turning now to the drawings in more detail, numeral 10 designates the vaporizer apparatus or simply vaporizer according to the present invention. The vaporizer 10 comprises a hollow vaporizer body 12, a hollow smoke and vapor exhaust stem member 14 detachably engageable with an upper part of the vaporizer body 12, a heat producing member 16 removably received in the vaporizer body 12, a cup member 18 for supporting a pre-determined amount of a botanical substance, and a vapor collection member 20 detachable engageable with a top of the exhaust stem 14. These major components of the vaporizer are co-axially arranged, as shown in FIG. 1, when the vaporizer apparatus is used.

The vaporizer body 12 comprises a hollow tubular portion 30 and a flask-shaped portion 32 mounted ever a lower part of the tubular portion. The flask-shaped portion 32 has a bottom opening 34, which is aligned with a central opening 22 of the hollow tubular portion 30. The flask-shaped portion 32 has a generally conical configuration.

A neck portion 36 of the flask-shaped portion has non-smooth exterior to facilitate easy handling by the user. The neck portion 36 has an enlarged diameter upper 11 flange 38, which allows a securing clip to be positioned on the body 12, as will be described in more detail hereinafter. A gap is formed between, the exterior of the tubular portion 50 and the interior of the neck portion **3*b* for receiving and detachable engaging a tower part 38 of the smoke and vapor exhaust stem 14**, similar to a stopper for a flask.

Figure 2:
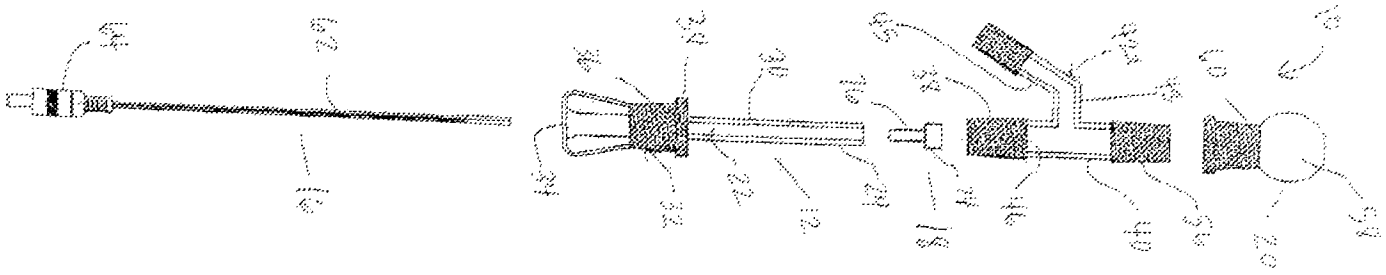
FIG. 2 is an exploded view of the vaporizer shown in FIG. 1.

In one aspect, of the invention, the smoke and vapor exhaust stem 14 is configured similar to a standard adapter having an elongated hollow stent 40 and a side bend 42 fluidly connected to a central opening 40 formed in the stent 40. The side bend 42 can extend at about 45 degrees in relation to a longitudinal, axis of the central opening 46, as shown in FIG. 1, or can be a two-part member similar to the element shown in FIG. 2. In FIG. 2, the side bend **42*a* has a proximate part 43, which is affixed to the stem 40 at a right angle, and an angularly extending part 45, which is unitary continuously connected to the proximate part 43 and extends at an obtuse angle to the proximate part 43. A connection member 47 is titled to a free end of the side bend 42 to allow engagement of the side bend 42 with a receiver 80 of a water pipe 82**.

Figure 3:
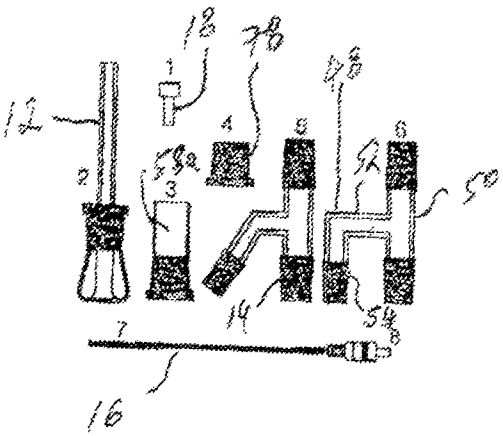
FIG. 3 is a schematic view illustrating kit components of the vaporizer of the present invention with angular and straight-angle connectors.

In another alternative embodiment illustrated in FIG. 3, the vaporizer assembly of this invention can be provided with a smoke and vapor exhaust stem having a general configuration of a chosen adapter. In this embodiment a two-part side bend 48 is unitary secured to the stem 50 via a proximate part 52, which extends at a right angle to the longitudinal axis of the stem 50. A distant part 54, which extends at a right angle relative to the proximate part 52, is unitary continuously connected to the proximate part 52. In this embodiment the distant part 54 may extend in parallel or at obtuse angle to the stem 50.

The interior diameter of the stem 40 or 50 is large enough to receive at least a part the tubular portion 30 of the vaporizer body 12 when the detachable engageable vaporizer components are assembled in a manner shown in FIG. 1. When assembled, the lower part 38 of the exhaust stem member 14 fits into the neck portion 30 of the flask-shaped portion 32 of the body 12, while the tubular portion 30 extends through the opening 45 formed in the stem 40. In some aspects of the invention, the tubular portion 30 has greater longitudinal dimensions than the stem 40 such that at least an upper part 24 of the tubular portion 30 extends outwardly and upwardly from the stem 40.

The vapor collection member 20 is detachable engageable with a top engagement member 56 of the stem 40. Similarly to the lower part 38 of the stem 40, the top engagement member has a frustoconical configuration for ease of engaging with an adjacent component.

Figure 4:
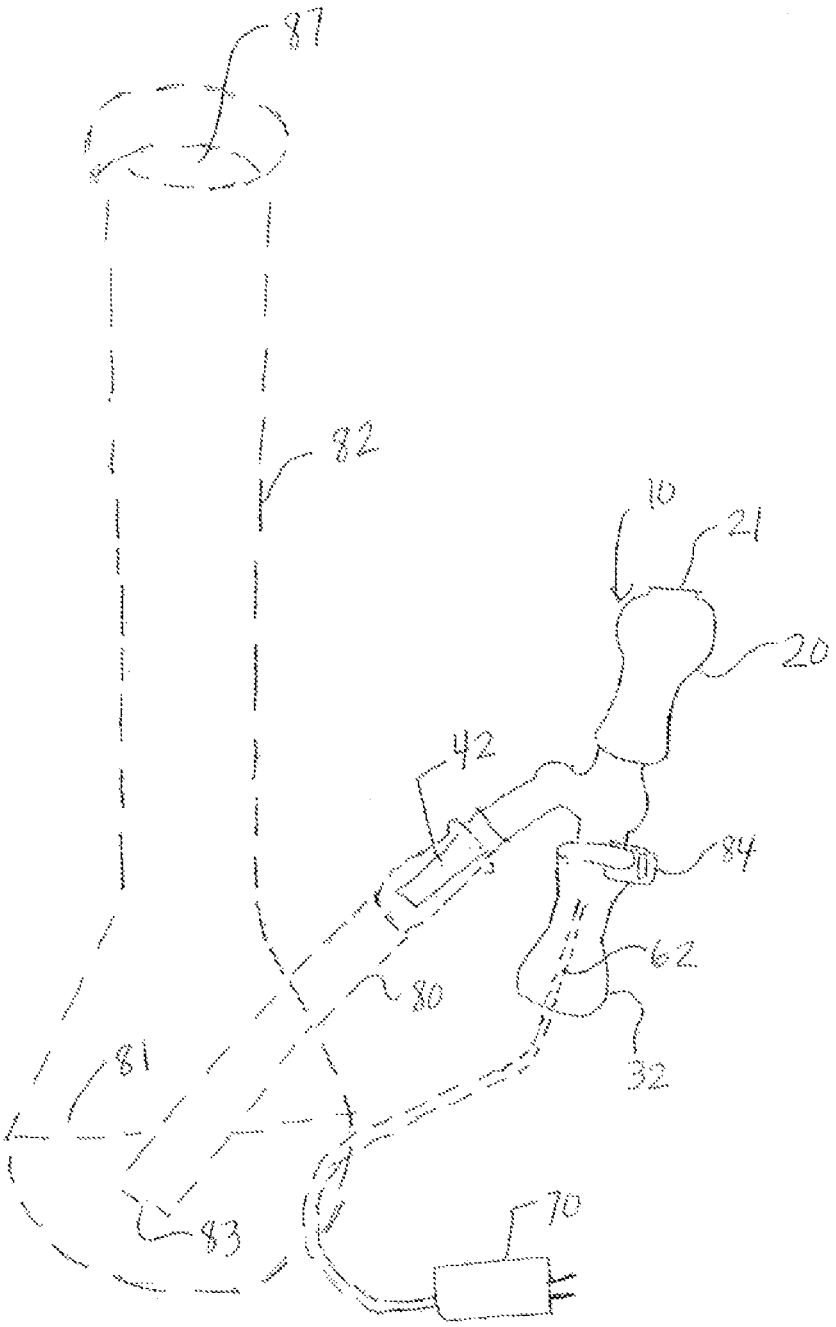
FIG. 4 illustrates the vaporizer apparatus of the present invention connected to a water pipe.

The vapor collection member 20 is mounted in a surrounding relationship to the upper part 24 of the tubular portion 30. The interior of the vapor collection member 20 defines a vapor collection chamber 58, which is in fluid communication with the tubular portion 30 of the body 12 and with the stem 40 of the exhaust stem member 14. The vapor collection chamber can have a dome-shaped configuration, as shown in FIGS. 1, 2, and 4, or it can have a cylindrical, configuration, as shown, in FIG. 3, at 58*a*. An access opening 21 is formed centrally in the vapor collection member 20 to allow access to the cup member 18.

A lower part 60 of the vapor collection, member 20 receives the top engagement member 56 of the stem 40, detachable engaging the stem 40. An exterior of the lower part 60 can be formed non-smooth to facilitate handling of the component by the user.

The heating element or heat producing member 16 is fitted to extend through the tubular portion 30 and outwardly from the stem 40 into the vapor chamber 58, 58*a*. The heating element in comprises an elongated heating rod 62 having a power connector 64 fitted on its bottom portion. The power connector 64 has a plug 68 engageable with a transformer 70 via a length of wiring 72. The transformer 70 can be a standard 18V DC transformer that can be plugged into a municipal AC power source. The heating, element 16 is formed from a heat-conductive material, for instance stainless steel.

The cup member 18 is also formed from a heat conductive material. In one aspect of the invention, the cup member 18 is formed from titanium. Of course, other materials can be used if desired. The cup member 18 comprises a top bowl portion 74 supported by a centrally located shaft 76. The shaft 76 has an opening allowing the shaft to be removably fitted onto the rod 62 in a heat-transferring relationship.

The bowl 74 has an indentation in its upper surface sufficient to receive a pre-determined quantity of a vaporizable substance. The vaporizable substance can be a tobacco leaf extract, a botanical extract, or a medicinal herb extract, admixed with a suitable carrier, such as natural wax.

The kit containing the vaporizer assembly 10 may also include an optional adapter 78 (FIG. 3) to fit a various-size receiver 80. The adapter 78 may be 14 mm to 18 mm adapter to be mounted between the connection member 47 and the receiver 80 of the water pipe 82.

To facilitate secure engagement of the stem 40 with the flask 32, a clip 84 is provided. The clip 84 engages the stem 40 and the flange 38 of the flask neck 36 when the vaporizer 10 is in operation.

The kit containing the vaporizer assembly 10 comes with instructions describing in detail the manner of use of the vaporizer 10. Some designs of the vaporizer 10 cart be factory pre-assembled, while others come as a kit with several components. For instance, a kit using an angular side head 42 can come pre-assembled to be attached to a water pipe having a 45-degree angle and a 14 mm glass receiver. Alternatively, the body 12 can be pre-assembled with the heating element 16 and the smoke and vapor exhaust stems 14, 50 and the vapor collector 20 placed separately in the shipping container.

In operation, the user is instructed, to assemble all components of the vaporizer 10. The clip 84 is used to temporary secure the smoke and vapor exhaust stem 14 or 50 to the body 12. A quantity of water is deposited into the water pipe 82 to a level 81, which should be above an outlet end 83 of the receiver 80. As can be seen in FIG. 4, the outlet end 83 is submerged below the water line 81. The user then engages the male-end side bend member 42 with the female receiver 80 of the water pipe 82.

The user then connects the power connector 68 to the transformer 70 and plugs the transformer 70 into a wall receptacle. The electrical power causes the heating rod 62 to heat and transmit the heat to the cup member 18. The cup member 18 is capable of heating to between 800 and 1000 degrees Fahrenheit. The heating continues for about 3-4 minutes until the desired temperature is reached. The user then deposits a small amount of the botanical substance into the bowl 74 using the access opening 21. In some aspect of the invention, the bowl 74 is sized to hold 10-15 mg of the herbal material. The botanical substance is vaporized, causing the carrier material to melt, while releasing smoke and other gaseous substances.

The smoke is directed into the exhaust stem member 14 or 50 and exits the vaporizer 10 through the side bend 42. The side bend outlet is so disposed so that the gas stream is forced beneath, water surface in the water pipe 82. The inhalable substance in the gas form is allowed to bubble up through the fluid to the surface, absorbing moisture as it rises to the water surface and having the amount of impurities and tar substantially reduced. The smoke or inhalable medicinal substance exits the water pipe 82 through an open top 87, when the user inhales the smoke. The solid part of the vaporizable substance is melted and flows downstream into the flask-shaped portion 32, where it is collected for future disposal.

The vaporizer apparatus 10 of the present invention, operates on clean and safe electrical power, eliminating the need to use combustible power source. The vaporizer 10 is easily transportable, is small and is simple to operate. The majority of components, such as the body 12, the exhaust stem member 14, and the vapor collector 20 can be made of glass or other heat-resistant material, if desired, the water pipe 82 can be provided with a lid and a flexible hose can be connected to the lid. The user then uses a mouth piece of the flexible hose to inhale the substance created during vaporization in the vaporizer 10.

Many other changes and modifications can be made in the design of the present invention without departing from the spirit thereof. I, therefore, pray that my rights to the present invention be limited only by the scope of the appended claims.

I claim:

1. A vaporization apparatus, comprising:

a hollow vaporizer body;

a heating element extending through the vaporizer body;

a cup member supported atop of the heating element, said cup member receiving a pre-determined quantity of a vaporizable material; and an exhaust stem member mountable to said vaporizable body, the exhaust stem member receiving an exhaust gaseous substance generated during heating of the vaporizable material and directing said gaseous substance outside of the vaporizer body, the vaporizer body comprising an elongated hollow tubular portion and a flask-shaped portion mounted over a lower part of the tubular portion.

2. The apparatus of claim 1, the flask-shaped portion being co-axially engaged with the tubular portion and arranged to receive a solid part of the vaporizable substance released during heating of the vaporizable substance.

3. A vaporization apparatus connectable to a device for inhaling an inhalable substance, the apparatus comprising:

a hollow vaporizer body having an elongated tubular portion and a flask-shaped portion disposed about a lower part of the tubular portion;

a heat-conductive element extending through the vaporizer body in co-axial relationship with the tubular portion;

a cup member supported atop of the heat-conductive element, said cup member having a stem detachably connectable to the heat-conductive element and a bowl receiving a pre-determined quantity of a vaporizable material; and an exhaust stem member mountable to said vaporizer body, the exhaust stem member receiving an exhaust gaseous substance generated during heating of the vaporizable material and directing the gaseous substance through a fluid medium deposited in the device for inhaling an inhalable substance.

4. The apparatus of claim 3, comprising a vapor collector member detachably engageable with the tubular portion of the exhaust stem member, the vapor collector member being provided with a top access opening arranged in alignment with said bowl of the cup member for depositing of the vaporizable substance into the cup member.

5. The apparatus of claim 3, said exhaust stem member comprising a hollow stem portion mounted in co-axial relationship to the tubular portion of the vaporizer body and a hollow side bend member extending at an angle to the stem member.

6. The apparatus of claim 5, wherein the side bend member is disposed to detachably engage a receiver member of the device for inhaling an inhalable substance.

7. The apparatus of claim 3, the flask-shaped portion being co-axially engaged with the tubular portion of the vaporizer body.

8. The apparatus of claim 3, said heat-conductive element being arranged for connection to an electric power source.

9. The apparatus of claim 3, wherein the cup member is formed from heat-conductive material.

10. The apparatus of claim 3, wherein the vaporizer body and the exhaust stem member are formed from a heat-resistant material.

11. The apparatus of claim 3, comprising a direct current transformer electrically connectable between the heating element and a source of alternating current.

12. The apparatus of claim 3, wherein said heat-conductive element is capable of being heated to a sufficient degree to cause vaporization of the vaporizable substance.

13. The apparatus of claim 3, wherein said heat-conductive element is capable of being heated to between 800 and 1000 degrees Fahrenheit.

14. A vaporization apparatus connectable to a water pipe containing a fluid medium and having an inhalation outlet, the apparatus comprising:

a hollow vaporizer body having an elongated tubular portion and a flask-shaped portion disposed about a lower part of the tubular portion;

an electrically-heated heating element extending through the vaporizer body in co-axial relationship with the tubular portion;

a cup member supported atop of the heat-conductive element, said cup member having a stem detachably connectable to the heat-conductive element and a bowl receiving a pre-determined quantity of a vaporizable material; and an exhaust stem member mountable to said vaporizer body, the exhaust stem member receiving an exhaust gaseous substance generated during heating of the vaporizable material and directing the gaseous substance through the fluid medium contained in the water pipe.

15. The apparatus of claim 14, comprising a vapor collector member detachably engageable with the tubular portion of the exhaust stem member, the vapor collector member being provided with a top access opening arranged in alignment with said bowl of the cup member for depositing of the vaporizable substance into the cup member.

16. The apparatus of claim 14, said exhaust stem member comprising a hollow stem portion mounted in co-axial relationship to the tubular portion of the vaporizer body and a hollow side bend member extending at an angle to the stem member, an outlet of the side bend member extending below the water surface when the vaporization apparatus is mounted on the water pipe.

17. The apparatus of claim 16, wherein the side bend member is disposed to detachably engage a receiver member of the water pipe.

18. The apparatus of claim 14, the flask-shaped portion being co-axially engaged with the tubular portion of the vaporizer body.

19. The apparatus of claim 14, said heating element being arranged for connection to an electric power source.

20. The apparatus of claim 14, wherein the cup member is formed from heat-conductive material.

21. The apparatus of claim 14, wherein the vaporizer body and the exhaust stem member are formed from a heat-resistant material.

22. The apparatus of claim 14, comprising a direct current transformer electrically connectable between the heating element and a source of alternating current.

23. The apparatus of claim 14, wherein said heating element is capable of being heated to a sufficient degree to cause vaporization of the vaporizable substance.

24. The apparatus of claim 14, wherein said heating element is capable of being heated to between 800 and 1000 degrees Fahrenheit.

* * * * *